US006810226B2

(12) United States Patent
Phillips et al.

(10) Patent No.: US 6,810,226 B2
(45) Date of Patent: Oct. 26, 2004

(54) ELECTROPHOTOGRAPHIC TONER CONTAINMENT APPARATUS AND METHODS

(75) Inventors: Quintin Phillips, Boise, ID (US); John Huffman, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/356,789

(22) Filed: Jan. 31, 2003

(65) Prior Publication Data

US 2004/0151520 A1 Aug. 5, 2004

(51) Int. Cl.[7] ..... G03G 15/08
(52) U.S. Cl. ..... 399/258; 399/160
(58) Field of Search ..... 399/252–263

(56) References Cited

U.S. PATENT DOCUMENTS 4,435,065 A * 3/1984 Wada ..... 399/260
4,650,097 A * 3/1987 Hagihara et al. ..... 399/260
5,548,385 A * 8/1996 Takai et al.
5,652,947 A * 7/1997 Izumizaki ..... 399/258
6,026,253 A * 2/2000 Domon et al.

FOREIGN PATENT DOCUMENTS

JP 02197875 A * 8/1990 ..... G03G/15/08
JP 08220859 A * 8/1996 ..... G03G/15/08
JP 10020746 A * 1/1998 ..... G03G/15/08

* cited by examiner

*Primary Examiner*—Arthur T. Grimley
*Assistant Examiner*—Ryan Gleitz

(57) ABSTRACT

Apparatus include a toner cartridge that defines a primary toner reservoir and at least one secondary toner reservoir. A gate device is also included, wherein the gate device is configured to selectively control the flow of toner from the secondary toner reservoir to the primary toner reservoir. Methods of operating a toner cartridge include providing a toner cartridge having a primary toner reservoir and a secondary toner reservoir. The toner cartridge is operated to initially deplete toner from the primary toner reservoir. At a given level of toner depletion from the primary toner reservoir, toner is dumped from the secondary toner reservoir into the primary toner reservoir for replenishment thereof.

20 Claims, 2 Drawing Sheets

ELECTROPHOTOGRAPHIC TONER CONTAINMENT APPARATUS AND METHODS

BACKGROUND OF THE INVENTION

Electrophotographic imaging devices and their operation are generally well known in the art. Conventional electrophotographic imaging devices include a photoconductive surface that is often supported on the exterior of a rotatable, cylindrical drum. The typical electrophotographic imaging device also includes a light source. The photoconductive surface is configured to be moved past the light source during production of an image.

The light source can be in the form of a laser, or a series of light-emitting diodes, or the like. In any case, the light source is configured to be directed at the photoconductive surface and across the width thereof as the photoconductive surface is moved past the light source. The light source is also typically configured to be selectively pulsed as it is directed at the moving photoconductive surface.

Such pulsing of the light source while it is directed at the moving photoconductive surface allows a two-dimensional latent image to be produced on the photoconductive surface. The image is "latent" in that it is defined primarily only by a difference in the electrical charge of specific areas of the photoconductive surface. That is, the electrical charge of the areas of the photoconductive surface that make up the "image" is typically substantially different from the electrical charge of the areas that do not make up the image.

In addition to the light source and the photoconductive surface, conventional electrophotographic imaging devices also typically include a developing system. The developing system is configured to apply toner to the latent image on the photoconductive surface so as to "develop" the latent image into a visual image. After the image is developed on the photoconductive surface, it is ultimately transferred to a final image carrier, or medium, such as a sheet of paper.

The developing system often includes a toner reservoir, or storage container, as well as a toner metering/distribution mechanism. The toner metering/distribution mechanism is configured to draw toner from the toner reservoir and apply or distribute the toner onto the photoconductive surface in order to develop the latent image into a visual image. The toner generally has an associated electrical charge so that, when the toner is applied to the latent image on the photoconductive surface, the toner adheres to the portions of the surface which make up the latent image, and does not adhere to the remainder of the surface.

The toner reservoir and the toner metering/distribution mechanism are often incorporated into a toner "cartridge" that can be conveniently removed and/or installed into the imaging device. The "cartridge" configuration of the toner reservoir and toner metering/distribution mechanism is beneficial in that replenishment of toner requires only that the empty toner cartridge be removed from the imaging device followed by the installation of a full toner cartridge.

Typically, conventional toner metering/distribution mechanisms include some type of stirring device that is configured to stir or physically agitate the toner stored within the toner reservoir. Such stirring and/or agitation of the toner generally aids in distribution of the toner. However, prolonged stirring of the toner can have deleterious effects on the toner charge. For example, prolonged stirring of the toner by a stirring device within the toner reservoir can cause a significant loss of toner charge. Such a loss of toner charge can result in poor performance of the toner and/or degraded image quality.

SUMMARY OF THE INVENTION

In accordance with one embodiment of the present invention, a toner cartridge includes a body that defines a primary toner reservoir and a secondary toner reservoir. The toner cartridge also includes a gate device that is operatively supported, at least in part, by the body, and that is configured to selectively release toner from the secondary toner reservoir and into the primary toner reservoir. Additional secondary toner reservoirs can be included, wherein a plurality of secondary toner reservoirs are configured to each release toner into the primary toner reservoir by way of respective associated gate devices. The toner cartridge can also include an activation mechanism that is configured to open and/or close the gate device.

In accordance with another embodiment of the present invention, a method of operating a toner cartridge includes providing a toner cartridge that defines a primary toner reservoir and a secondary toner reservoir. The method also includes placing a primary quantity of toner in the primary toner reservoir, and placing a secondary quantity of toner in the secondary toner reservoir. The toner cartridge can be operated to deplete the primary quantity of toner from the primary toner reservoir. The secondary quantity of toner can be automatically dumped from the secondary reservoir into the primary toner reservoir.

DETAILED DESCRIPTION

Various embodiments of the present invention include apparatus and methods for containing electrophotographic imaging toner. More specifically, a toner cartridge in accordance with one embodiment of the present invention includes at least one primary toner reservoir and at least one secondary toner reservoir. During operation of the toner cartridge, toner is drawn from the primary toner reservoir until the toner is drawn down to a predetermined level. When the predetermined level of toner within the primary toner reservoir is reached, toner from the secondary toner reservoir can be dumped into the primary toner reservoir for replenishment thereof. In this manner, exposure of toner to moving components, such as stirring devices and distribution rollers, can be reduced, thus also reducing the probability of toner charge degradation.

Figure 1:
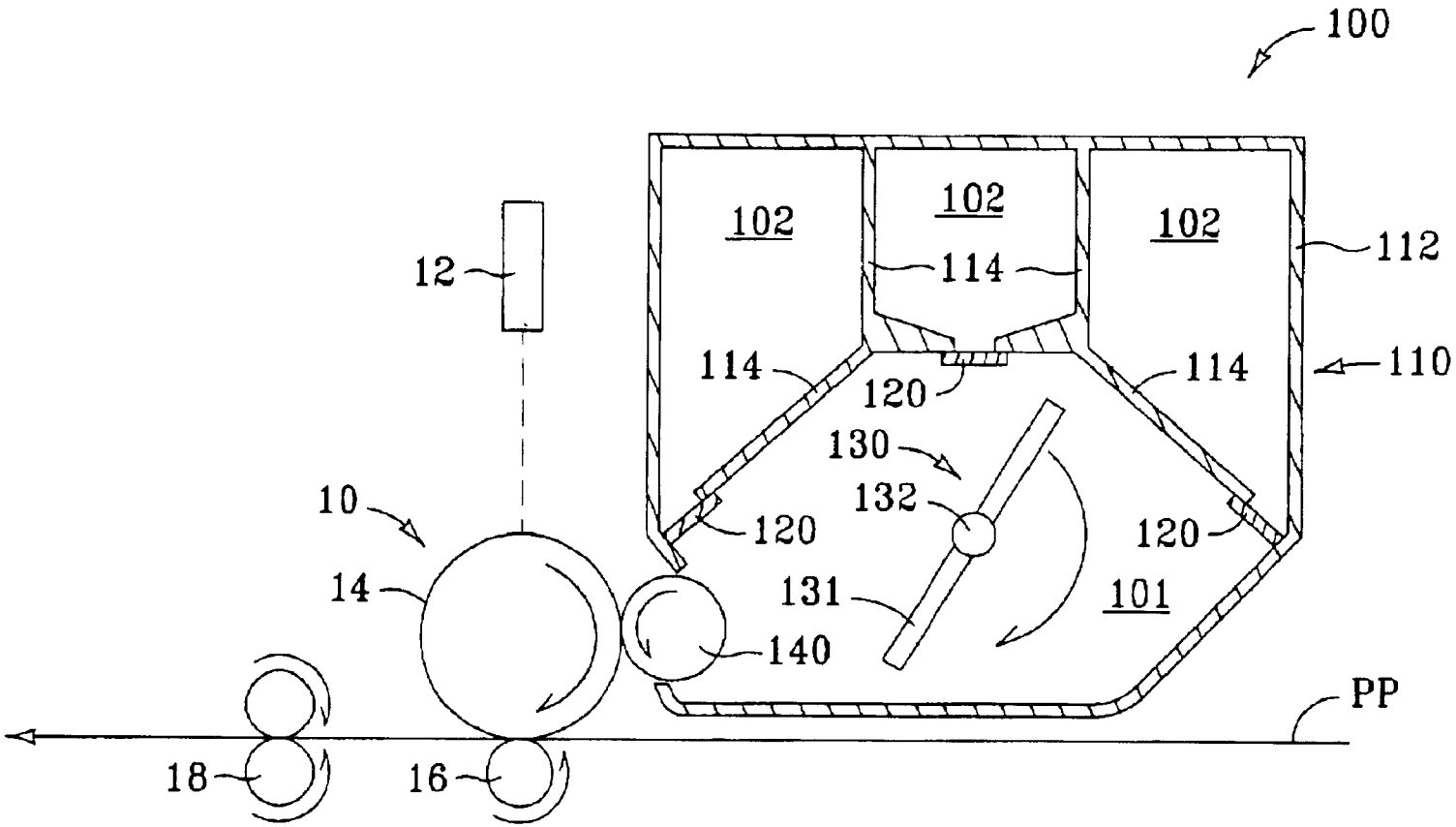
FIG. 1 is a side elevation sectional view in which a toner cartridge is depicted in accordance with one embodiment of the present invention.

With reference now to FIG. 1, a side elevation sectional view is shown in which a toner cartridge 100 is depicted in accordance with one embodiment of the present invention. The toner cartridge 100 can be configured to be operatively supported by an electrophotographic imaging device 10 that is depicted schematically in FIG. 1, and is included therein for reference purposes. The imaging device 10 generally includes a light source 12, a photoconductive surface 14 in the form of a rotatable drum, a transfer roller 16, a fuser 18, and a paper path PP. The general configuration and operation of imaging devices, such as the imaging 10, are well known in the art as described briefly above, and thus need not be described in further detail.

The toner cartridge 100 includes a body 110 and at least one gate device 120 which is described below. The body 110 defines a primary toner reservoir 101 and at least one secondary toner reservoir 102. The primary toner reservoir 101 and the secondary toner reservoir 102 can be substantially enclosed as depicted, and can be configured to contain therein respective quantities of toner (not shown). More specifically, the primary toner reservoir 101 can be configured to contain therein a primary quantity of toner, while the secondary toner reservoir 102 can be configured to contain therein a secondary quantity of toner.

The toner contained in the secondary toner reservoir 102 can be of the same type as the toner contained in the primary toner reservoir 101, although the toners need not be the same. As is discussed in further detail below, the primary purpose of the secondary toner reservoir 102 is to provide a replenishment supply of toner to the primary toner reservoir 101 when the toner in the primary reservoir is depleted to a given level. That is, as the imaging device 10 operates, toner is drawn initially from the primary toner reservoir 101. When the toner in the primary toner reservoir 101 is depleted to a given, predetermined level, toner from the secondary toner reservoir 102 can be transferred to the primary toner reservoir.

The toner cartridge 100 can include a stirring device 130 that can be operatively supported within the primary toner reservoir 101. The stirring device 130 can be operatively supported by the body 110. Stirring devices are known in the art and thus, need not be described in detail. The stirring device 130 can be configured to rotate, by way of example only, in the direction indicated. It is understood that other directions of rotation and manners of movement of the stirring device 130 are contemplated in accordance with the various embodiments of the invention. The stirring device 130 can include one or more paddle elements 131 that are supported by a hub element 132. The paddle elements 131 can be configured to rotate about the hub element 132 as shown.

The toner cartridge 100 can also include a distribution roller 140 that can be operatively supported by the body 110, and can be configured to rotate as indicated. The distribution roller 140 can be configured to draw toner from the primary toner reservoir 101 and to transfer the toner to the photoconductive surface 14 by way of rotation of the distribution roller. The stirring device 130 can facilitate the function of the distribution roller 140 by moving toner within the primary toner reservoir 101 toward the distribution roller. That is, the toner from the primary toner reservoir 101 is "picked up" by the distribution roller 140 which moves the toner into contact, or into close proximity, with the photoconductive surface 14. The toner can then adhere to portions of the photoconductive surface 14 which make up the image.

Although the primary toner reservoir 101 and the secondary toner reservoirs 102 are depicted so as to have specific shapes and relative sizes, it is understood that the primary toner reservoir and the secondary toner reservoirs can have any of a number of possible shapes and relative sizes. For example, the operational volume of the secondary toner reservoir 102 can be at least one half the operational volume of the primary reservoir 101. Alternatively, and by way of further example, the operational volume of the secondary toner reservoir 102 can be at least the same as the operational volume of the primary toner reservoir 101. The term "operational volume," as used herein, is defined as the volume of toner that is generally placed into the respective toner reservoir before initial use of the toner cartridge.

With continued reference to FIG. 1, the body 110 of the toner cartridge 100 can include an exterior wall 112 that encloses both the primary toner reservoir 101 and the secondary reservoir 102. The body 110 can also include an interior partition 114 that can be connected to the exterior wall 112. The exterior wall 112 and the interior partition 114 together can form the primary toner reservoir 101 and the secondary toner reservoir 102. That is, the primary toner reservoir 101 can be bounded by both the exterior wall 112 and the interior partition 114. Likewise each of the secondary toner reservoirs 102 can also be bounded by both the exterior wall 112 and the interior partition 114.

As is seen, the gate device 120 can be operatively supported by the body 110. In the case wherein the toner cartridge 100 includes a plurality of gate devices 120, each of the plurality of gate devices can be exclusively operationally associated with a corresponding secondary toner reservoir 102. That is, in the case of a plurality of secondary toner reservoirs 102 and a plurality of gate devices 120, each of the secondary toner reservoirs 102 can have an associated gate device that operates to selectively release toner from the respective associated toner reservoir only and no other.

Figure 2:
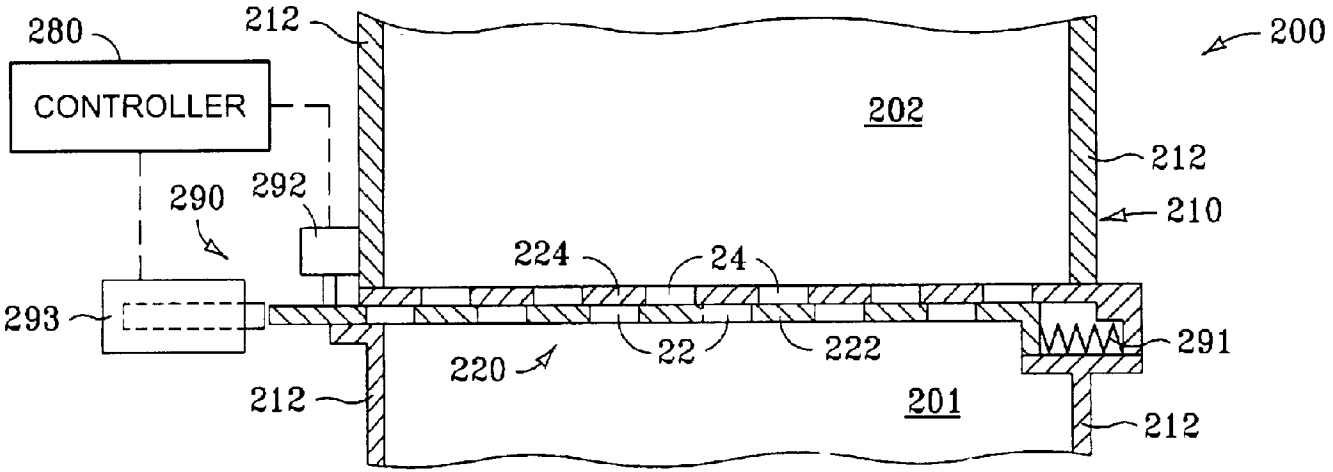
FIG. 2 is a front elevation sectional view in which a toner cartridge is depicted in accordance with another embodiment of the present invention, showing one configuration of the gate device.

Turning now to FIG. 2, a front sectional view is shown in which a toner cartridge 200 is depicted in accordance with another embodiment of the present invention. The toner cartridge 200 can be configured in a manner substantially similar to that of the toner cartridge 100 which is discussed above in conjunction with FIG. 1. The toner cartridge 200 includes a gate device 220 which can be configured in a manner substantially similar to that of the gate device 120 which is also discussed above in conjunction with FIG. 1.

Figure 3:
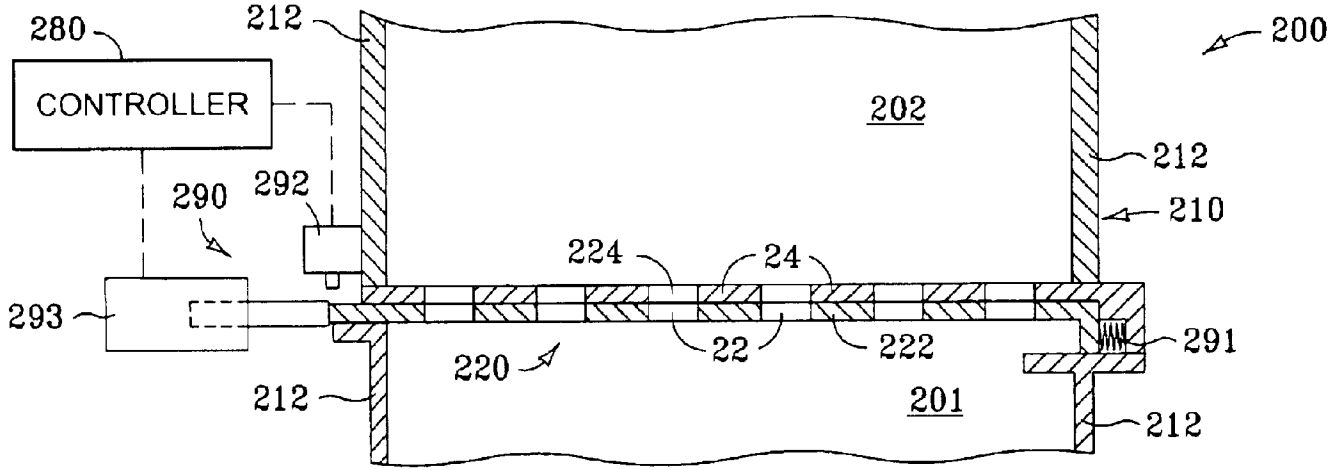
FIG. 3 is another front elevation sectional view in which the toner cartridge depicted in FIG. 2 is shown with a different position of the gate device.

Turning to FIG. 3, another front sectional view is shown in which the toner cartridge 200 is depicted. With reference to FIGS. 2 and 3, it is seen that the primary difference therebetween is that the gate device 220 is shown in a closed position in FIG. 2, while in FIG. 3, the gate device is shown in an open position. It can be appreciated that the primary purpose of FIGS. 2 and 3 is to illustrate, by way of example only, at least one of several possible configurations of the gate device 220 in accordance with the present invention.

As is seen, the toner cartridge 200 can include a body 210 that can be substantially similar to the body 110 that is discussed above with respect to the toner cartridge 100. The body 210 defines at least one primary toner reservoir 201, and at least one secondary toner reservoir 202. The gate device 220 can be located between the primary toner reservoir 201 and the secondary toner reservoir 202 so as to be capable of selectively controlling the flow of toner from the secondary toner reservoir 202 to the primary toner reservoir 201. As is further shown, the secondary toner reservoir 202 can be located substantially above the primary toner reservoir 201 so that toner flow from the secondary toner reservoir to the primary toner reservoir can be accomplished primarily by way of gravitational force acting on the toner.

As briefly discussed above, the gate device 220 can be configured to move between a closed position and an open position. In the closed position, which is illustrated in FIG. 2 by way of example only, the gate device 220 can hold toner in the associated secondary toner reservoir 102. That is, in the closed position, the gate device 220 can serve to prevent the flow of toner from the associated secondary toner reservoir 202 to the primary toner reservoir 201. In the open position, which is illustrated in FIG. 3 by way of example only, the gate device 220 can serve to enable toner to flow, under gravitational force, from the associated secondary toner reservoir 202 and into the primary toner reservoir 201.

As mentioned above, the general purpose of the gate device 220 can be accomplished in any of a number of possible manners. That is, the gate device 220 can be configured in any of a number of possible ways, one of which is illustrated by way of example only, in FIGS. 2 and 3. Thus, it is understood that the gate device 220 can be configured in alternative manners which are not specifically depicted herein and which are not specifically described, but which are still consistent with the general concepts of the various embodiments of the invention described herein.

Also, it is understood that in the illustrative example provided by FIGS. 2 and 3, not all of the components which are shown need be included in the toner cartridge 200. That is, of the components depicted, some are optional, as is explained further below. Furthermore, of the components depicted, at least some of those components can be configured in any of several different manners while still functioning in a manner consistent with that described herein.

With reference now to FIGS. 2 and 3, the body 210 of the toner cartridge 200 can include a pair of spaced-apart exterior walls 212 that can at least partially define the primary toner reservoir 201 and/or the secondary toner reservoir 202 in a manner similar to that of the exterior wall 212 which is described above with respect to the toner cartridge 100. The gate device 220 can be substantially elongated and can extend between the exterior walls 212 substantially in the manner depicted.

The gate device 220 can include gate element 222 that is movably supported by the body 210. The gate element 222 can be slidably supported by the body 210 so that the gate element is slidable between the closed position (as depicted in FIG. 2) and the open position (as depicted in FIG. 3). The gate device 220 can also include a plate 224 that can be connected in a stationary manner to the body 210. Thus, the gate element 222 can be movable, and more specifically, can be slidable relative to the plate 224.

The plate 224 can define therethrough at least one plate opening 24. Similarly, the gate element 222 can define therethrough at least one gate opening 22. The plate 224 and the gate element 222 can be configured in respective manners wherein, when the gate device 220 is in the closed position, the plate openings 24 are blocked by the gate element as is depicted in FIG. 2. Alternately, plate openings 24 and the gate openings 22 can be located such that, when the gate device 220 is in the open position, the plate openings and the gate openings are in substantial registered alignment with one another as is depicted in FIG. 3.

In this manner, when the gate device 220 is in the closed position, toner flow through the plate openings 24 can be blocked by the gate element 222. On the other hand, when the gate device 220 is in the open position, toner can flow, by way of gravitational force, through the gate device by way of the plate openings 24 and the gate openings 22. That is, when the gate device 220 is in the open position, toner flow can be enabled from the secondary toner reservoir 202 to the primary toner reservoir 201 by flowing first through the plate openings 24 and then through the gate openings 22.

The toner cartridge 200 can also include an activator mechanism 290. The activator mechanism 290 can be configured in any of a number of possible manners, at least some of which are described below by way of example only. The function of the activator mechanism 290 is to facilitate selective activation of the gate device 220. That is, the activator mechanism 290 can be configured to selectively move the gate device 220 from the closed position to the open position. The activator mechanism 290 can also be configured to selectively move the gate device 220 from the open position to the closed position, as is described below in detail. Specifically, by way of example only, the activator mechanism is depicted in FIGS. 2 and 3 as being configured to move the gate element 222.

As mentioned above, several different possible specific configurations of the activator mechanism 290 are contemplated in accordance with various embodiments of the present invention. For example, in accordance with one possible configuration of the activator mechanism 290, a biasing member 291 can be included therein. The biasing member 291 can have any one of a number of possible forms, including that of a metallic spring, a plastic spring, an air spring, an elastic member, or the like. The biasing member 291 is preferably supported by the body 210, generally in the manner depicted. That is, preferably, the biasing member 291 is operatively connected between the body 210 and the gate element 222.

The biasing member 291 can be configured to provide a biasing force on the gate element 222. The biasing force provided by the biasing member 291 can be directed so as to bias the gate member toward the open position (as shown in FIG. 3). In other words, as depicted in FIG. 2, the biasing member 291 can be in tension so as to provide a biasing force on the gate member 222 so as to bias the gate member in the open position while being held in the closed position. It is understood, however, that an alternative configuration of the gate device 220 and the biasing member 291 can result in the biasing member being in compression while the biasing force biases the gate element 222 in the open position.

In any case, a release mechanism 292 can be included in the activator mechanism 290 along with the biasing member 291. The release mechanism 292 can be operatively supported on the body 210 as shown. The release mechanism 292 can be configured to function so as to releasably hold the gate member 222 in the closed position against the biasing force provided by the biasing member 291. That is, as depicted in FIG. 2, the biasing member 291 can provide a biasing force on the gate member 222, wherein the biasing force biases the gate member in the open position, but wherein the release mechanism 292 is configured to releasably hold the gate member in the closed position against the biasing force until the gate element is released by the release mechanism.

For example, a controller 280 can be provided to control the operation of the release mechanism 292. That is, the controller 280 can be linked in signal communication with the release mechanism 292, whereby the controller can selectively cause the activation of the release mechanism. The release mechanism 292 can have any of a number of possible forms. For example, the release mechanism 292 can be in the form of an electrical fuse, an electrical circuit breaker, an electrical relay, or the like which, when tripped by an electrical current, results in the release of the gate member 222.

The controller 280 can be configured to make a decision to activate the release mechanism 292 based on predetermined criteria. As is discussed in greater detail below, such criteria can include, for example, attainment of a given level of toner within the primary toner reservoir 201, the expiration of a given period of time, the attainment of a given number of images produced. Other specific criteria on which a decision to activate the release mechanism 292 are possible.

In any case, when the decision to activate the release mechanism 292 is made by the controller 280, the controller can send a signal to the release mechanism 292, whereby the signal results in activation of the release mechanism, causing the release mechanism to release the gate member 222. The signal can be in the form of a pulse of electrical current, or can be in the form of a data signal, for example.

When the gate member 222 is released by the release mechanism 292, the biasing force provided by the biasing member 291 can cause the gate member to move from the closed position to the open position, whereby toner flow from the secondary toner reservoir 202 to the primary toner reservoir 201 can be enabled. As mentioned, the controller 280 can base the decision to activate the release mechanism 292 on any of a number of criteria.

For example, the decision can be based on the detection of a given level of toner in the primary toner reservoir 201. That is, the controller 280 can be configured to monitor the level of toner within the primary toner reservoir 201, and/or to detect when the toner within the primary toner reservoir reaches a predetermined level. In this manner, when the primary quantity of toner within the primary toner reservoir 201 becomes low, for example, this situation can be detected by the controller 280, which can then make a decision to activate the release mechanism 292, thereby causing the gate device 220 to open, and enabling toner flow from the secondary reservoir 202 to the primary toner reservoir 201.

Various methods and apparatus for monitoring and/or detecting toner level are known in the art and can thus be employed in the manner described. Additionally, other criteria on which the decision to activate the release mechanism is based can also be employed as mentioned above. These alternative criteria can include elapsed time, the number of sheets of media processed, the number and/or type of images produced, and the like.

Furthermore, as an alternative to the configuration of the activation mechanism 290 as described above, the activation mechanism 290 can include an actuator 293 in place of the release mechanism 292. The actuator 293 can have any of a number of possible forms including, for example, that of a solenoid, an air cylinder, or the like. Additionally, the actuator 293 can be operatively supported on the body 210 of the toner cartridge 200 or can be operatively supported on another object, such as an imaging device or the like which is also configured to operatively support the toner cartridge 200.

The actuator 293 can be configured to move the gate device 220 from the closed position to the open position, and/or vice versa. That is, by way of example only, the actuator 293 can be configured to move the gate member 222 from the closed position to the open position as depicted. Thus, when the actuator 293 is included in the activator mechanism 290, the biasing member 291 need not be included. Additionally, as briefly mentioned above, the actuator 293 can be a double-acting actuator in which case the actuator can be configured to not only move the gate element 222 from the closed position to the open position, but can be configured to also move the gate element from the open position to the closed position.

However, even if the actuator 293 is a single-acting actuator, the gate device 220 can still be configured to move not only from the closed position to the open position, but also from the open position to the closed position. For example, in addition to the actuator 293, the activator mechanism 290 can include the biasing member 291. However, in that case the biasing member 291 can be configured to apply a biasing force to the gate element 222, wherein the biasing force biases the gate element in the closed position rather than in the open position as is described above.

In this manner, by applying a biasing force to the gate element 222 which biases the gate element in the closed position, the actuator 293 can be configured to move the gate element 222 from the closed position to the open position against the biasing force provided by the biasing member 291. Conversely, the biasing member 291 can be configured to move the gate element 222 from the open position to the closed position by way of the biasing force applied to the gate element.

That is, if the actuator 293 is a single-acting actuator, the actuator can be selectively activated to move the gate element 222 from the closed position to the open position against the biasing force provided by the biasing member 291. The actuator 293 can also thus be selectively deactivated, wherein the biasing member 291 can move the gate element 222 from the open position to the closed position, and thus also moving the actuator 293 back to its original position.

The controller 280 can be linked in signal communication with the actuator 293 in a manner similar to that described above with respect to the release mechanism 292. In this way, the controller 280 can selectively activate the actuator 293 in a manner similar to that which is also described above with respect to the release mechanism 292. That is, the controller 280 can make a decision, based on predetermined criteria, to activate the actuator 293 so as to cause the gate element 222 to move from the closed position to the open position.

Additionally, the controller 280 can be configured to make another decision to deactivate the actuator 293, or to reverse the direction of actuation thereof, based on different criteria. For example, the secondary toner reservoir 202 can be configured to contain a secondary quantity of toner that is substantially greater than the primary quantity of toner that the primary toner reservoir 201 is configured to contain. Thus, in that case the entire secondary quantity of toner should not be dumped into the primary toner reservoir 201, because to do so may overload the primary toner reservoir with toner.

Instead, the controller 280 can initially monitor for, and/or detect, a low level of toner in the primary toner reservoir 201. Once this detection is made, the controller 280 can cause the gate device 220 to move from the closed position to the open position as is described above by way of example in conjunction with the illustrative depictions provided by FIGS. 2 and 3. When the gate device 220 is caused to open by the controller 280, toner can begin flowing from the secondary toner reservoir 202 and into the primary toner reservoir 201.

The controller 280 can then initiate a timer sequence or the like to measure a predetermined period of elapsed time. When the predetermined period of elapsed time has passed, the controller 280 can then make a decision to deactivate the actuator 293 in the case of a single-acting actuator, or in the alternative, cause the direction of actuation to be reversed in the case of a double-acting actuator. This can cause the gate device 220 to move from the open position to the closed position as is described above, thus terminating the flow of toner from the secondary toner reservoir 201 to the primary toner reservoir 202. In this manner, the controller 280 can cause a predetermined quantity of toner to flow from the secondary toner reservoir 202 into the primary toner reservoir 201 while also preventing the entire quantity of toner in the secondary toner reservoir from flowing into the primary toner reservoir.

As an alternative to initiating a timing sequence on which to base the measurement of toner flowing from the secondary toner reservoir 202 to the primary toner reservoir 201, the controller 280 can be configured to monitor the change in the level of toner in the primary toner reservoir. That is, the controller 280 can be configured to detect a level of toner within the primary toner reservoir 201 at which the flow of toner should be terminated to prevent overfilling thereof. As mentioned above, various methods and apparatus for detecting toner levels are known in the art and can be thus employed in the manner described herein.

Turning back to FIG. 1, although a toner cartridge in accordance with an embodiment of the present invention can include only a single secondary toner reservoir 102, it is understood that in accordance with at least one other alternative embodiment, such as the toner cartridge 100 that is described above and depicted in FIG. 1, a plurality of secondary toner reservoirs 102 can be included. As is also discussed above, in such a case, a plurality of gate devices 120 are preferably included in the toner cartridge 100 as well, wherein each gate device is exclusively operationally associated with a corresponding secondary toner reservoir 102.

Each of the gate devices 120 can be configured to operate in one of many possible manners, including those of the gate device 220 which is described above with respect to the toner cartridge 200. Also, with regard to the operation of the toner cartridge 100 having a plurality of secondary toner reservoirs 102, each of the gate devices 120 can be opened one-at-a-time, and at consecutive intervals. That is, a typical operational scheme of the toner cartridge 100 as specifically depicted in FIG. 1 can include initially placing a primary quantity of toner in the primary toner reservoir 101, and placing a secondary quantity of toner in each of the secondary toner reservoirs 102.

Such an operational scheme can also include operating the electrophotographic imaging device 10, as well as operating the toner cartridge 100. During such operation of the toner cartridge 100, the primary quantity of toner can be drawn from the primary toner reservoir 101 and can be transferred to the photoconductive surface 14 by way of the distribution roller 140, for example. In this manner, toner can be depleted from the primary toner reservoir 101 while each of the secondary toner reservoirs 102 holds therein the respective secondary quantity of toner.

Additionally, the level of toner in the primary toner reservoir 101 can be monitored, for example, as is described above with respect to the toner cartridge 200. That is, a controller (not shown) or the like, in conjunction with a sensor, or a timer, or an image counter (not shown) can be configured to determine when the toner in the primary toner reservoir 101 is depleted to a given level, as is described above.

For example, the given level can be a level at which toner has been nearly depleted from the primary toner reservoir 101. When the given toner level in the primary toner reservoir 101 is detected, one of the gate devices 120 can be activated, or opened, to cause the associated secondary toner quantity to be released from the secondary toner reservoir 102 and to flow therefrom into the primary toner reservoir.

That is, when the given toner level in the primary toner reservoir 101 is detected, one of the three gate devices 120 can be caused to open, thereby allowing the toner in the associated secondary toner reservoir 102 to be dumped into the primary toner reservoir. Thus, after such an event, two of the secondary toner reservoirs 102 would still contain toner, while the third would be empty, having had its contents of toner dumped into the primary toner reservoir. The toner cartridge 100 can then continue operation while this new toner supply is depleted from the primary toner reservoir 101.

When the given toner level is detected once again in the primary toner reservoir 101, the second of the three gate devices 120 can be caused to open, thus allowing the toner contained in the associated secondary toner reservoir 102 to flow into the primary toner reservoir 101. After this event, two of the three secondary toner reservoirs 102 would be empty of toner, while one of the three secondary toner reservoirs would still contain toner. The toner cartridge 100 can then continue to operate in the manner described above, wherein at a predetermined time, the remaining secondary quantity of toner in the third secondary toner reservoir 102 can be dumped into the primary toner reservoir 101 in the manner described above.

It is understood that any of a number of different criteria can be employed for causing a given gate device 120 to open. That is, as is described above by way of illustrative example, one such criterion can be the level of toner detected in the primary toner reservoir 101. However, additional criteria can include, for example, the quantity of images produced, as well as the number of pages of media processed. Other examples of such criteria include elapsed time, and image quality deterioration, etc.

In accordance with another embodiment of the present invention, a method of operating a toner cartridge includes providing a toner cartridge that includes a primary toner reservoir and a secondary toner reservoir. Such a toner cartridge can be, for example, the toner cartridge 100 which is described above and which is depicted in FIG. 1. The method can also include placing a primary quantity of toner in the primary toner reservoir, and placing a secondary quantity of toner in the secondary toner reservoir. The toner cartridge can be operated so as to deplete the primary quantity of toner from the primary toner cartridge to a given level, and automatically dumping the secondary quantity of toner from the secondary toner reservoir into the primary toner reservoir.

The method can further include commencing dumping of the secondary quantity of toner from the secondary toner reservoir into the primary toner reservoir, and allowing a given time interval to elapse. The dumping of the secondary quantity of toner from the secondary toner reservoir into the primary toner reservoir can be stopped at the end of the given time interval. Thus, during the given time interval, only a portion of the secondary quantity of toner is dumped from the secondary toner reservoir into the primary toner reservoir.

Alternatively, the step of automatically dumping the secondary quantity of toner from the secondary toner reservoir into the primary toner reservoir can include continuously dumping the secondary quantity of toner from the secondary toner reservoir until substantially all of the secondary quantity of toner has been transferred to the primary toner reservoir. That is, rather than dumping only a portion of the secondary quantity of toner from the secondary toner reservoir into the primary toner reservoir, the entire secondary quantity of toner can be dumped from the secondary toner reservoir into the primary toner reservoir.

In accordance with yet another embodiment of the present invention, another method of operating a toner cartridge includes providing a toner cartridge that includes a primary toner reservoir and a plurality of secondary toner reservoirs. A primary quantity of toner can be placed into the primary toner reservoir, while a secondary quantity of toner can be placed into each of the secondary toner reservoirs. The toner cartridge can be operated so as to deplete the primary quantity of toner from the primary toner reservoir.

The method further includes automatically dumping one of the secondary quantities of toner from the respective secondary toner reservoir into the primary toner reservoir. The method can further include continuing to operate the toner cartridge so as to deplete the secondary quantity of toner from the primary toner reservoir, and then automatically dumping another one of the secondary quantities of toner from the respective secondary toner reservoir into the primary toner reservoir.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A toner cartridge, comprising:

a body that defines therein:

a primary toner reservoir; and, a secondary toner reservoir; and, a gate device that is operatively supported, at least in part, by the body, and that is configured to move from a closed position to an open position to release toner from the secondary toner reservoir and into the primary toner reservoir, wherein the gate device comprises:

a gate element slidably supported by the body, wherein the gate element defines therethrough a plurality of gate openings; and, a plate stationarily supported by the body, wherein:

the plate defines therethrough a plurality of plate openings;

the gate openings and the plate openings are blocked when the gate device is in the closed position; and, the gate openings and the plate openings are in substantial registered alignment with one another when the gate device is in the open position.

2. The toner cartridge of claim 1, and further comprising a stirring device operatively mounted within the primary toner reservoir.

3. The toner cartridge of claim 1, and further comprising a distribution roller operatively supported by the body.

4. The toner cartridge of claim 1, and wherein the operational volume of the secondary toner reservoir is at least the same as the operational volume of the primary toner reservoir.

5. The toner cartridge of claim 1, and wherein the operational volume of the secondary toner reservoir is at least one-half the operational volume of the primary toner reservoir.

6. The toner cartridge of claim 1, and wherein the body comprises:

an exterior wall that encloses the primary and secondary toner reservoirs; and, an interior partition connected to the exterior wall, wherein:

the primary toner reservoir is bounded by both the exterior wall and the interior partition; and, the secondary toner reservoir is bounded by both the exterior wall and the interior partition.

7. The toner cartridge of claim 1, and wherein the gate device comprises a gate element that is movable between a closed position and an open position, wherein:

toner flow is from the secondary toner reservoir to the primary toner reservoir is prevented when the gate element is in the closed position; and, toner flow from the secondary toner reservoir to the primary toner reservoir is enabled when the gate element is in the open position.

8. The toner cartridge of claim 7, and wherein the gate device further comprises an activator mechanism configured to move the gate element from the closed position to the open position.

9. The toner cartridge of claim 8, and wherein the activator mechanism comprises:

a biasing member that is supported by the body, and that is configured to provide a biasing force on the gate element, wherein the biasing force biases the gate element toward the open position; and, a release mechanism that is supported by the body, and that is configured to releasably hold the gate element in the closed position against the biasing force, and that is further configured to selectively release the gate element, thereby enabling the gate element to move from the closed position to the open position by way of the biasing force.

10. The toner cartridge of claim 8, and wherein the activator mechanism comprises a selectively controllable actuator that is configured to be selectively activated, wherein when activated, the actuator moves the gate element from the closed position to the open position.

11. The toner cartridge of claim 8, and wherein the activator mechanism comprises a biasing member that is supported by the body, and that is configured to provide a biasing force on the gate element, wherein the biasing force biases the gate element toward the closed position.

12. The toner cartridge of claim 11, and wherein the activator mechanism further comprises a selectively controllable actuator that is configured to be selectively activated, wherein when activated, the actuator moves the gate element from the closed position to the open position against the biasing force.

13. The toner cartridge of claim 12, and wherein the actuator is further configured to be selectively deactivated, wherein when deactivated, the actuator enables the gate element to move from the open position to the closed position by way of the biasing force.

14. The toner cartridge of claim 8, and wherein:

the gate element is substantially supported by the body; and, the activator mechanism is substantially supported by the body.

15. The toner cartridge of claim 8, and wherein:

the toner cartridge is configured to be operatively supported by an imaging device;

the gate element is substantially supported by the body of the toner cartridge; and, the activator mechanism is substantially supported by the imaging device.

16. The toner cartridge of claim 1, and further comprising:

a biasing member supported by the body and operatively connected between the body and the gate member to bias the gate member in the open position; and, a release mechanism supported by the body and configured to releasably hold the gate member in the closed position against the biasing member.

17. The toner cartridge of claim 16, and wherein the release mechanism is selected from the group consisting of an electrical fuse, an electrical circuit breaker, and an electrical relay.

18. A method of operating a toner cartridge, comprising:

providing a toner cartridge that includes a primary toner reservoir and a plurality of secondary toner reservoirs;

placing a primary quantity of toner in the primary toner reservoir;

placing a respective secondary quantity of toner in each of the plurality of secondary toner reservoirs;

operating the toner cartridge to deplete the primary quantity of toner from the primary toner reservoir;

automatically detecting that the primary quantity of toner is depleted;

automatically dumping one of the secondary quantities of toner, by way of gravitational force alone, from the respective secondary toner reservoir into the primary toner reservoir in response to detecting that the primary quantity of toner is depleted;

continuing to operate the toner cartridge to deplete one of the secondary toner quantities from the primary toner reservoir;

automatically detecting that one of the secondary quantities of toner is depleted from the primary toner reservoir; and, automatically dumping another one of the secondary quantities of toner, by way of gravitational force alone, from the respective secondary toner reservoir into the primary toner reservoir in response to detecting that one of the secondary quantities of toner is depleted from the primary toner reservoir.

19. A toner cartridge, comprising:

a body that defines therein a primary toner reservoir, and a secondary toner reservoir; and, a gate device that is operatively supported by the body, and that is configured to move from a closed position to an open position to release toner from the secondary toner reservoir and into the primary toner reservoir, wherein the gate device comprises:

a biasing member supported by the body and configured to bias the gate device in the open position; and, a release mechanism supported by the body and configured to releasably hold the gate device in the closed position against the biasing member, wherein the release mechanism is selected from the group consisting of an electrical fuse, an electrical circuit breaker, and an electrical relay.

20. The toner cartridge of claim 19, and wherein the release mechanism is configured to be tripped by an electrical current, thereby resulting in the opening of the gate device.

* * * * *

UNITED STATES PATENT AND TRADEMARK OFFICE

CERTIFICATE OF CORRECTION

PATENT NO. : 6,810,226 B2
APPLICATION NO. : 10/356789
DATED : October 26, 2004
INVENTOR(S) : Phillips et al.

It is certified that error appears in the above-identified patent and that said Letters Patent is hereby corrected as shown below:

Col. 12 (line 66), delete “member” and insert therefor --element--.

Col. 12 (line 67), delete “member” and insert therefor --element--.

Col. 13 (line 2), delete “member” and insert therefor --element--.

Signed and Sealed this

Fourth Day of September, 2007

JON W. DUDAS
*Director of the United States Patent and Trademark Office*